United States Patent [19]

Niggemeier et al.

[11] 4,179,998

[45] Dec. 25, 1979

[54] HEAD INSERT FOR RAILWAY TRAILER HITCH

[75] Inventors: Joseph F. Niggemeier, St. Charles, Mo.; Richard P. Yeates, Downers Grove, Ill.

[73] Assignee: ACF Industries, Incorporated, New York, N.Y.

[21] Appl. No.: 914,313

[22] Filed: Jun. 12, 1978

Related U.S. Application Data

[62] Division of Ser. No. 825,560, Aug. 18, 1977, abandoned.

[51] Int. Cl.[2] ..... B65J 1/22

[52] U.S. Cl. ..... 410/64; 308/120 R; 308/239

[58] Field of Search ..... 280/433–437; 105/368 S; 248/119 S; 403/11, 13, 14; 308/239, 120

[56] References Cited

U.S. PATENT DOCUMENTS

| | | | |
|---|---|---|---|
| 2,602,713 | 7/1952 | Hatcher | 308/237 R |
| 2,821,444 | 1/1958 | Brown | 308/23 |
| 3,181,480 | 5/1965 | Sherrie et al. | 105/368 S |

FOREIGN PATENT DOCUMENTS

| | | | |
|---|---|---|---|
| 13563 | 6/1956 | Fed. Rep. of Germany | 308/239 |

OTHER PUBLICATIONS

Maintenance Manual, AFC Industries "Model 4 Trailer Hitch" 5/1973.

*Primary Examiner*—Lawrence J. Oresky
*Attorney, Agent, or Firm*—Henry W. Cummings

[57] ABSTRACT

In a railway trailer hitch, a wear resistant and crack resistant insert is removably attached to a fixed portion of the head which is subject to wear or cracking in service. The insert is made of a material which reduces or avoids wear and cracking of the fixed portion. If wear or cracking does occur, it tends to take place in the insert. An old insert can be easily and quickly removed and a new insert inserted into the head so that the hitch is not taken out of service to repair or replace the top plate.

5 Claims, 13 Drawing Figures

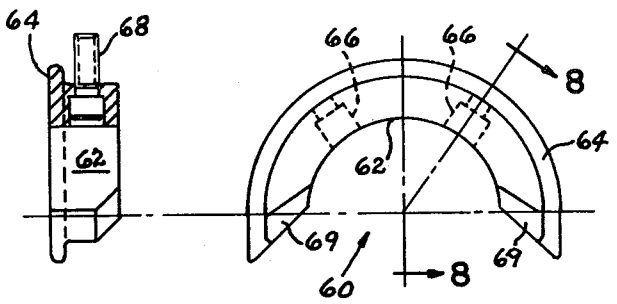
FIG. 7.
FIG. 8.
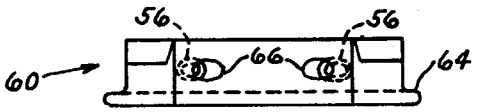
FIG. 7A.
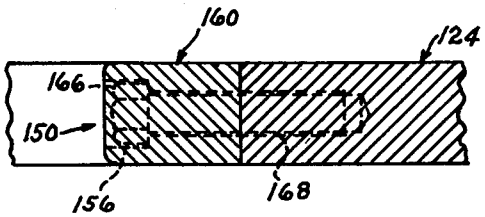
FIG. 12.
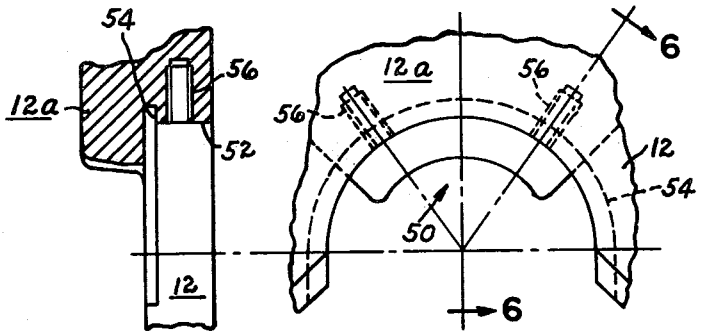
FIG. 5.
FIG. 6.
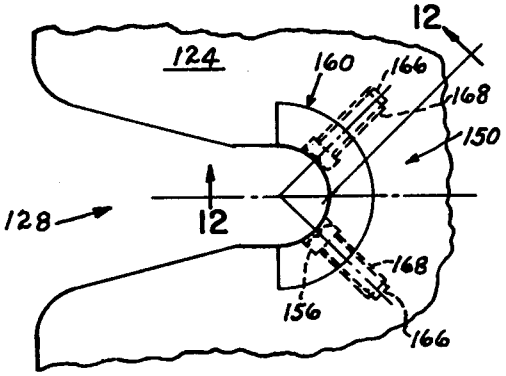
FIG. 11.

HEAD INSERT FOR RAILWAY TRAILER HITCH

This is a division of application Ser. No. 825,560, filed Aug. 18, 1977 now abandoned.

BACKGROUND OF THE INVENTION

This invention relates to railway trailer hitches.

One currently used head design for railway trailer hitches includes a top plate having an opening into which a fixed jaw is inserted. The fixed jaw is a carbon steel forging. A movable jaw is supported for back and forth movement relative to the fixed jaw for locking the king pin of a trailer to the fifth wheel. The movable jaw is provided with movable extensions, and a lock screw mounted below the fifth wheel plate engages the extensions to move the movable jaw between open and closed positions.

A locking bar extending transversely of the head engages the extensions to maintain the movable jaw in closed position. See U.S. Pat. Nos. 3,145,000 and 3,964,766.

The fixed jaw forging has been subject to wear. When the fixed jaw has worn to the design limits, the jaw requires repair or replacement. To accomplish either repair or replacement is expensive. Moreover the car must be taken out of revenue service during the replacement period.

In another hitch head design, a pair of movable jaws are mounted below the top plate. A yoke engages the jaws and a stiff spring urges the yoke and the jaws into the closed position below a semi-circular top plate opening. See U.S. Pat. No. 3,225,707. In this arrangement the top plate has been subject to wear and cracking.

SUMMARY OF THE INVENTION

In a railway trailer hitch, a wear resistant insert is removably attached to a fixed portion of the top plate of the head which is subject to wear and/or cracking in service. The insert is made of material which reduces or avoids wear and cracking of the fixed portion. If wear or cracking does occur, it tends to take place in the insert rather than in the remainder of the top plate. An old insert can be quickly and easily removed and a new insert inserted into the head so that the hitch is not taken out of service to repair or replace the top plate. The insert is held in place with mechanical fasteners which pass through openings in the top plate and in the insert. A projection may be provided on the insert and a groove provided in the top plant to assist in maintaining the insert in place while in service.

THE DRAWINGS

FIG. 5 is an enlarged plan view of the top plate shown in FIG. 1 and illustrating the insert of the present invention;

FIG. 6 is a sectional view looking in the direction of the arrows along the line 6—6 in FIG. 5;

FIG. 7 is a detailed plan view of the insert of the present invention;

FIG. 7A is a front view of the insert shown in FIG. 7;

FIG. 8 is a sectional view looking in the direction of the arrows along the line 8—8 in FIG. 7;

FIG. 11 is a view of the top plate of the embodiment shown in FIGS. 9 and 10 with the insert in place;

FIG. 12 is a sectional view looking in the direction of the arrows along the line 12—12 in FIG. 11.

DESCRIPTION OF PREFERRED EMBODIMENTS

Figure 2:
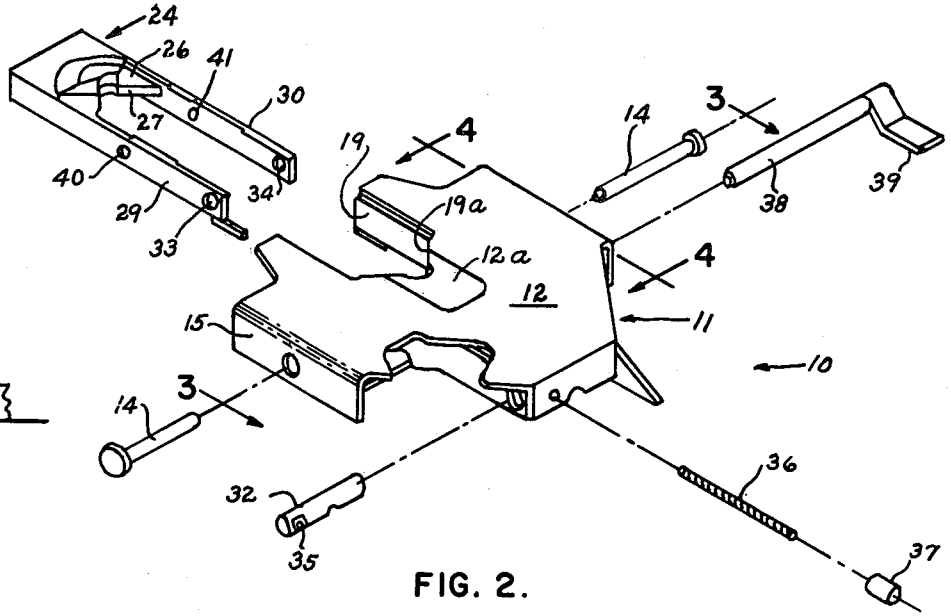
FIG. 2 is an exploded perspective view of a fifth wheel for trailer hitches.
Figure 1:
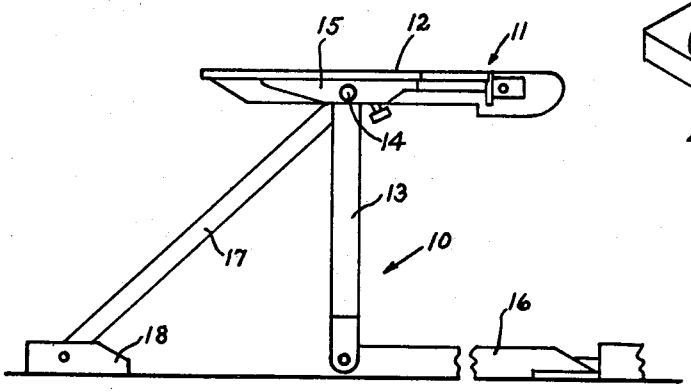
FIG. 1 is a side elevational view of a trailer hitch of a type adapted to be positioned on a railway flat car for securing trailers thereto.

As shown in FIG. 1 a trailer hitch 10 includes a fifth wheel 11 having a top plate 12 including a fixed jaw **12*a* (FIG. 2) made of a hardened steel forging. The top plate 12 is supported on an upright pedestal 13 pivotally connected by means of a pivot pin 14 to bracket portion 15 (only one being shown) projecting downwardly below the top plate 12. The present trailer hitch may be pivotally supported at the end of a cushioning device 16 carried on the floor of a conventional flat car. Alternatively the hitch may be uncushioned or may be cushioned in the diagonal strut 17 as disclosed in U.S. Pat. Nos. 3,145,000 or 3,490,723. The pedestal and trailer hitch assembly may be collapsed in a manner which is conventional and is disclosed in U.S. Pat. Nos. 3,493,207 or in 3,145,000 or 3,225,707. The diagonal strut 17 is suitably pivotally connected to a pivot bracket 18** adapted to be secured to a railway flat car.

The top plate 12 includes an enlarged slot 19 which terminates at one end thereof and at its other includes diverging gathering surfaces **19*a***.

Figure 3:
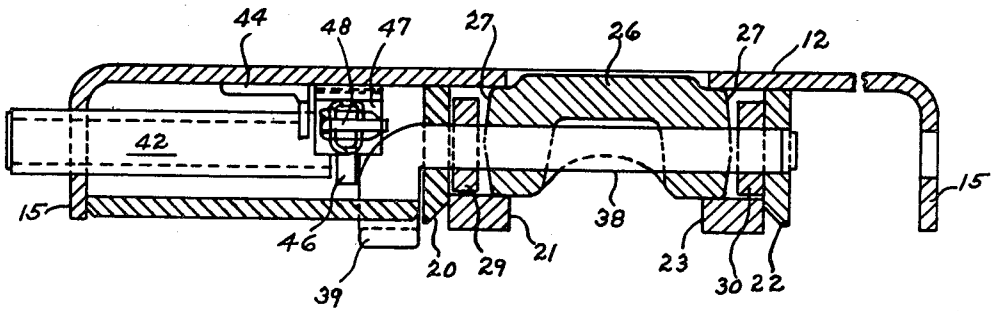
FIG. 3 is a sectional view looking in the direction of the arrows along the line 3—3 in FIG. 2.

As shown in FIG. 3 a pair of depending vertical plates 20 and 22 are welded to the lower surface of top plate 12. A movable jaw assembly indicated generally at 24 includes a movable jaw 26 having tapered guide surfaces 27 and a pair of extensions 29 and 30. As shown in FIG. 3 the extensions 29 and 30 are located within vertical plates 20 and 22. Movable jaw 26 is supported by horizontally extending plates 21 and 23 welded to respective vertical plates 20 and 22.

A transversely extending pin 32 is located within openings 33 and 34 within extensions 29 and 30. This pin includes a threaded opening 35 adapted to receive a longitudinally extending shaft 36 which is externally threaded. A tool connector 37 of square or hexigon cross section is provided to allow attachment of a suitable tool to rotate shaft 36 and move movable jaw 26 backward and forward between open and closed positions. A transversely extending locking pin 38 having a handle 39 is provided which enters openings 40 and 41 within movable jaw extensions 29 and 30 when the movable jaw is in the closed position.

Figure 4:
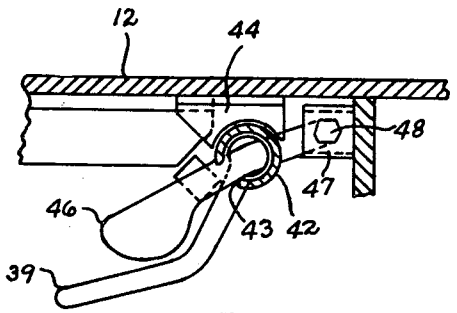
FIG. 4 is a cross-sectional view taken substantially along the line 4—4 of FIG. 2.

A tube 42 having a slot 43 is welded to a bracket 44 depending from top plate 12. A locking lever 46 is pivotally mounted about a bracket 47 by means of a pin 48. When the movable jaw assumes the closed position, locking pin 38 is inserted through slotted tube 42. When the locking pin 38 assumes the closed position shown in FIG. 3 the locking lever 46 is free to pivot about the pin 48 and assume the position shown in FIG. 4. The locking pin 38 can not be removed from the closed position shown in FIG. 3 until the locking lever 46 is moved out of the way and locking pin 38 is moved outwardly through slotted tube to release movable jaw 26. The foregoing construction is that of a commercially available trailer hitch. For a more detailed description see the *ACF Maintenance Manual Rigid Model V Trailer Hitch, Cushioned Model V Trailer Hitch,* dated Apr. 19, 1972, Revised October 1975, ACF Industries, Incorporated, Amcar Division, Clark and Main Streets, St. Charles, Mo. 63301, hereby incorporated into the present application by this reference. A copy is available in the application file.

In accordance with the present invention the top plate 12 is modified as shown in FIGS. 5–8 to receive a wear resistant insert assembly indicated generally at 50. For retrofit of existing jaws, the contoured semicircular top plate 12 and the hardened steel fixed jaw 12*a* are machined out, forming a generally semicircular slot 52, for example, having a radius of about 2.2 inches and a depth of about one (1) inch. In addition a groove 54 is machined which extends inwardly on a radius about 0.3 inches greater than the radius of machined slot 52. Groove 54 may have a depth of about 0.2 to about 0.3 inches.

In addition a plurality of threaded fastener openings 56 are drilled in jaw 12*a*.

A wear resistant insert indicated at 60, made of wear and crack resistant material is provided to be placed within slot 52. Insert 60 is preferably made of an alloy steel and is preferably heat treated to obtain hardness and strength. An example is AISI designation 4340 heat treated to 300–400 Brinell Hardness.

Insert 60 includes a generally semicircular body portion 62 and a generally semicircular projection 64. A plurality of drilled openings 66 are provided, preferably countersunk to receive fasteners 68. Fasteners 68 may be heat treated alloy steel cap screws at least 7/8 inch long having external threads. The insert is preferably machined at 69 to provided a tapered entrance surface for the kingpin.

When in place insert 60 significantly reduces the tendency for wearing and cracking to occur in jaw 12*a*. If wearing or cracking does occur, it tends to occur in insert 60, which can be easily and quickly replaced by removing fasteners 68.

During assembly projection 64 is located with groove 54. Fasteners 68 are preferably pretreated with a known locking composition and extend within countersunk openings 66 in the insert, and drilled openings 56 in the fixed jaw to maintain the insert in place. The fasteners are preferably torqued to about 45 ft. lbs.

Figure 10:
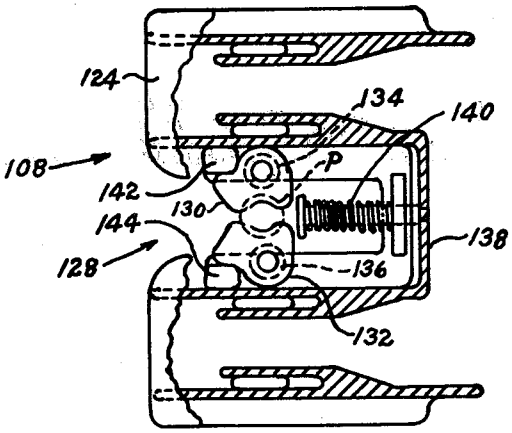
FIG. 10 is a top view partially in section illustrating the embodiment of the invention shown in FIG. 9.
Figure 9:
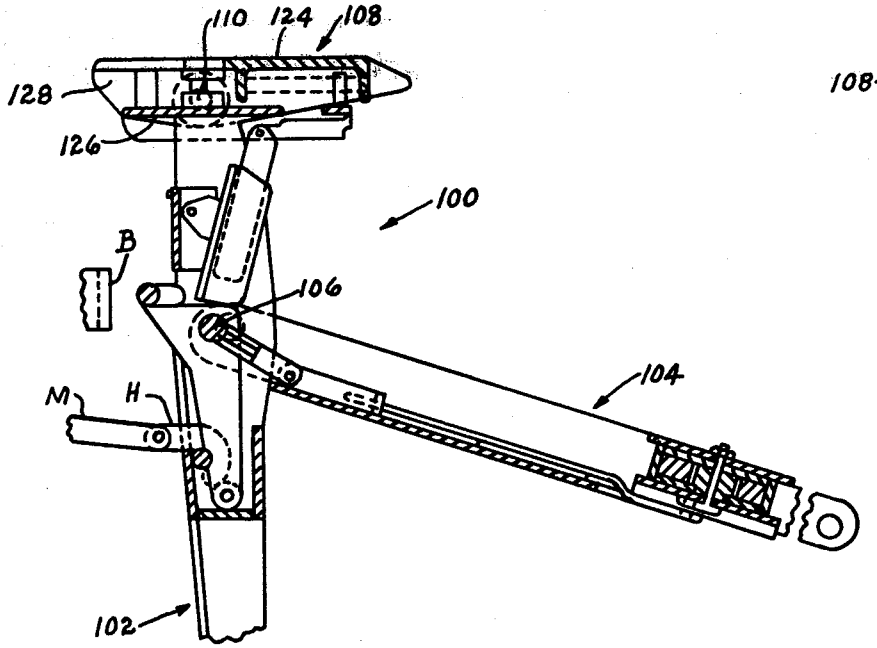
FIG. 9 is an elevation view partially in section of another embodiment of the present invention.

In another embodiment of the invention, the insert assembly of the present invention may also be used with the movable jaw arrangement shown in FIGS. 9 and 10. In this arrangement, hitch 100 comprises a vertical support member generally designated 102 and a diagonal support member 104 pivotally connected about horizontal pivot 106 to vertical support member 102. A hitch head generally designated 108 is pivotally connected about horizontal pivot 110 to the extending end of vertical support member 102. Hitch 100 is adapted to be pulled from a retracted position to an erect position by hook H on the rear of tractor M upon forward movement of the tractor. Bumper block B on the rear of tractor M is adapted to knock down hitch 100 to a retracted position from erect position upon rearward movement of tractor M, and effect unlocking of the trailer kingpin P and unlocking of diagonal support member 104 to permit retracting of hitch 100.

Hitch head 108 has top plate 124, a lower plate 126 and a tapered opening 128 at its forward end through which the kingpin is received as the hitch is raised, or as the trailer is moved rearwardly.

Kingpin P strikes jaws 130, 132, which are normally held open by torsion springs 134, 136, and turns them to their closed positions around the kingpin, as shown in FIG. 10. Yoke 138 is then moved rearwardly by stiff spring 140 until blocks 142, 144 of the yoke engage the backs of jaws 130, 132 as shown in FIG. 10. Jaws 130, 132 are then locked closed and cannot turn to their open positions. An operating bar (not shown) or the bumper B may be used to overcome the bias of springs 140 and allow the jaws to assume the open position for removal of the kingpin. U.S. Pat. No. 3,225,707, incorporated into the present application by this reference, may be referred to for a more detailed description of this type of hitch. Further information may be obtained from the *Maintenance Manual Model IV Trailer Hitch Rigid and Cushioned;* ACF Industries, Incorporated, Amcar Division, Clark and Main Streets, St. Charles, Mo. 63301. A copy is available in the application file.

Top plate 124 is subject to wear and cracking. Top plate 124 takes a significant portion of the horizontal kingpin loads in this arrangement in the vicinity of opening 128. As shown in FIG. 11 an insert assembly 150 including a hardened steel insert 160 held in place with fasteners 166 inserted through countersunk threaded openings 156 in the insert, and threaded openings 168 in the top plate, is provided. However a projection similar to projection 64 in FIGS. 7 and 8 may not be provided on insert 160 because top plate 124 is generally made of thinner material. In this embodiment the insert 160 extends the full vertical distance across the front of semicircular opening 128 (FIG. 12).

Insert 160 materially reduces wear and/or cracking of top plate 124. Wear and/or cracking which does occur tends to take place in insert 160, which can be easily and quickly replaced by removing fasteners 166.

What is claimed is:

1. In a trailer hitch to be mounted upon a railway flat car having a vertical strut and a diagonal strut in extended position supporting a hitch head adapted to engage and hold in place a kingpin of a trailer supported on said flat car, said hitch including a top plate having a given thickness having an opening including a generally semicircular kingpin engagement portion; a pair of movable jaws located below said top plate, a yoke engaging said movable jaws; a spring biasing said yoke and jaws into closed position; said jaws in closed position holding the kingpin captive in said head and adapted to engage said top plate, said kingpin applying horizontal loads to said kingpin engagement portion in transit, the improvement comprising:

an insert made of wear resistant and crack resistant material mounted on said top plate within said opening and overlying substantially the entire vertical extent of said kingpin engagement portion and the thickness of said insert being at least equal to said given thickness; fastening means engaging said insert and said top plate to hold said insert in place overlying said kingpin engagement portion; said insert being easily and quickly removable from said top plate by disconnecting said fasteners from said top plate, whereby a new insert may be quickly inserted in place within said opening while said hitch remains in place on said flat car without taking said flat car out of service.

2. An improved trailer hitch according to claim 1 wherein said insert is made of a heat treated alloy steel having a Brinell Hardness of about 300 to 400.

3. In a trailer hitch to be mounted upon a railway flat car having a vertical strut and a diagonal strut in extended position supporting a hitch head adapted to engage and hold in place a kingpin of a trailer, said hitch including a top plate having a given thickness having an opening including a generally semicircular kingpin engagement portion; a pair of movable jaws; a spring biasing said yoke and jaws into closed position; said jaws in closed position holding the kingpin captive in said head and adapted to engage said top plate, said kingpin applying horizontal loads to said kingpin engagement portion in transit, the improvement comprising: an insert made of wear resistant and crack resistant material mounted on said top plate within said opening and overlying said kingpin engagement portion; said insert including a horizontally extending projection and said top plate including a horizontal groove and wherein said projection extends within said groove to assist in maintaining said insert in place; said insert extending over substantially the entire vertical extent of said kingpin engagement portion and the thickness of said insert being at least equal to said given thickness; said insert being easily and quickly removable from said top plate by disconnecting said fasteners from said top plate, whereby a new insert may be quickly inserted in place within said opening while the hitch remains in place on said flat car without taking said hitch out of service.

4. An improved trailer hitch according to claim 3 wherein said fasteners engage first openings in said insert and second openings in said top plate.

5. An improved trailer hitch according to claim 4 wherein said first openings are countersunk.

* * * * *

UNITED STATES PATENT AND TRADEMARK OFFICE

CERTIFICATE OF CORRECTION

PATENT NO. : 4,179,998

DATED : December 25, 1979

INVENTOR(S) : Joseph F. Niggemeier and Richard P. Yeates

It is certified that error appears in the above-identified patent and that said Letters Patent are hereby corrected as shown below:

The title of this patent should read --Trailer Hitch Head Having Insert Including A Yoke And Movable Jaws--.

In Col. 1, line 21, "3,145,000" should read --3,145,006--.
line 51, "plant" should read --plate--.

In Col. 2, line 29, "3,145,000" should read --3,145,006--.
line 32, "3,145,000" should read --3,145,006--.
line 51, "hexigon" should read --hexagon--.

In Col. 3, line 2, after "tube", insert --42--.
line 38, "provided" should read --provide--.

Signed and Sealed this

*Eighth* Day of *April 1980*

[SEAL]

*Attest:*

SIDNEY A. DIAMOND

*Attesting Officer*

*Commissioner of Patents and Trademarks*